US010045128B2

(12) United States Patent
Shennib

(10) Patent No.: US 10,045,128 B2
(45) **Date of Patent: *Aug. 7, 2018**

(54) HEARING DEVICE TEST SYSTEM FOR NON-EXPERT USER AT HOME AND NON-CLINICAL SETTINGS

(71) Applicant: iHear Medical, Inc., San Leandro, CA (US)

(72) Inventor: Adnan Shennib, Oakland, CA (US)

(73) Assignee: iHear Medical, Inc., San Leandro, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/990,650

(22) Filed: Jan. 7, 2016

(65) Prior Publication Data

US 2016/0198271 A1 Jul. 7, 2016

Related U.S. Application Data

(60) Provisional application No. 62/100,876, filed on Jan. 7, 2015.

(51) Int. Cl.
*H04R 29/00* (2006.01)
*H04R 25/00* (2006.01)

(52) U.S. Cl.
CPC ..... *H04R 25/30* (2013.01); *H04R 25/70* (2013.01)

(58) Field of Classification Search
CPC .. H04R 25/70; H04R 2460/17; H04R 25/658; H04R 2225/61; H04R 25/60;
(Continued)

(56) References Cited

U.S. PATENT DOCUMENTS 4,759,070 A 7/1988 Voroba
5,197,332 A 3/1993 Shennib
(Continued)

FOREIGN PATENT DOCUMENTS

JP 57188235 A 11/1982
JP 06105828 A 4/1994
(Continued)

OTHER PUBLICATIONS

Internet Archive, World Health Organization website "Grades of Hearing Impairment". Retrieved from <https://web.archive.org/web/20121024120107/http://www.who.int/pbd/deafness/hearing_impairment_grades/en> on Aug. 27, 2015.
(Continued)

*Primary Examiner* — Norman Yu
(74) *Attorney, Agent, or Firm* — Dorsey & Whitney LLP

(57) ABSTRACT

A hearing device test system for use by a non-expert user may include a hearing device comprising a sound processor and a speaker and a portable test unit including a test microphone acoustically coupled to an exterior of the portable test unit via an acoustic calibration cavity. The portable test unit may include a coupler at an opening to the acoustic calibration cavity configured to receive the hearing device at least partially therein and the test microphone may be configured to produce a calibration signal input responsive to acoustic calibration stimuli provided by the speaker of the hearing device. The hearing device test system may also include a processor associated therewith and configured to measure a level of the calibration signal input.

24 Claims, 13 Drawing Sheets

(58) Field of Classification Search

CPC ..... H04R 25/00; H04R 25/556; H04R 25/65; H04R 25/305; H04R 25/608; H04R 25/652; H04R 2225/55; H04R 2225/39; H04R 2225/41; H04R 25/505; H04R 25/604; H04R 25/30; H04R 2430/01; H04R 2460/15; H04R 1/1066; H04R 2205/041; H04R 25/502; H04R 25/55; H04R 5/04; H04R 1/10; H04R 2201/10; H04R 2225/43; H04R 2420/07; H04R 25/353; H04R 25/407; H04R 25/43; H04R 25/48; H04R 5/033; H04M 1/2155; H04M 1/2475; H04M 1/6016; H04M 1/72591; G10L 15/01; G10L 21/02; H04S 2400/13

USPC ..... 381/328, 322, 60, 312, 329, 324, 315, 381/317, 58, 123, 23.1, 56; 180/130, 180/135, 129; 455/41.3; 73/585

See application file for complete search history.

(56) References Cited

U.S. PATENT DOCUMENTS 5,327,500 A 7/1994 Campbell
5,553,152 A 9/1996 Newton
5,645,074 A 7/1997 Shennib et al.
5,659,621 A 8/1997 Newton
5,701,348 A 12/1997 Shennib et al.
5,785,661 A 7/1998 Shennib et al.
5,928,160 A 7/1999 Clark
6,137,889 A 10/2000 Shennib et al.
6,212,283 B1 4/2001 Fletcher et al.
6,319,207 B1 11/2001 Naidoo
6,359,993 B2 3/2002 Brimhall
6,367,578 B1 4/2002 Shoemaker
6,379,314 B1 4/2002 Horn
6,382,346 B2 5/2002 Brimhall et al.
6,428,485 B1 8/2002 Rho
6,447,461 B1 9/2002 Eldon
6,473,513 B1 10/2002 Shennib et al.
6,522,988 B1 2/2003 Hou
6,546,108 B1 4/2003 Shennib et al.
6,674,862 B1 1/2004 Magilen
6,724,902 B1 4/2004 Shennib et al.
6,816,601 B2 11/2004 Lin et al.
6,840,908 B2 1/2005 Edwards et al.
6,937,735 B2 8/2005 DeRoo et al.
6,940,988 B1 9/2005 Shennib et al.
6,978,155 B2 12/2005 Berg
7,010,137 B1 3/2006 Leedom et al.
7,016,511 B1 3/2006 Shennib
7,037,274 B2 5/2006 Thoraton et al.
7,113,611 B2 9/2006 Leedom et al.
7,215,789 B2 5/2007 Shennib et al.
7,260,232 B2 8/2007 Shennib
7,298,857 B2 11/2007 Shennib et al.
7,310,426 B2 12/2007 Shennib et al.
7,321,663 B2 1/2008 Olsen
7,403,629 B1 7/2008 Aceti et al.
7,424,123 B2 9/2008 Shennib et al.
7,424,124 B2 9/2008 Shennib et al.
7,580,537 B2 8/2009 Urso et al.
7,664,282 B2 2/2010 Urso et al.
7,854,704 B2 12/2010 Givens et al.
7,945,065 B2 5/2011 Menzl et al.
8,073,170 B2 12/2011 Kondo et al.
8,077,890 B2 12/2011 Schumaier
8,155,361 B2 4/2012 Schindler
8,184,842 B2 5/2012 Howard et al.
8,243,972 B2 8/2012 Latzel
8,284,968 B2 10/2012 Schumaier
8,287,462 B2 10/2012 Givens et al.
8,379,871 B2 2/2013 Michael et al.
8,396,237 B2 3/2013 Schumaier
8,447,042 B2 5/2013 Gurin
8,467,556 B2 6/2013 Shennib et al.
8,503,703 B2 8/2013 Eaton et al.
8,571,247 B1 10/2013 Oezer
8,718,306 B2 5/2014 Gommel et al.
8,798,301 B2 8/2014 Shennib
8,855,345 B2 10/2014 Shennib et al.
9,031,247 B2 5/2015 Shennib
9,060,233 B2 6/2015 Shennib et al.
9,078,075 B2 7/2015 Shennib et al.
9,107,016 B2 8/2015 Shennib
9,326,706 B2 5/2016 Shennib
9,439,008 B2 9/2016 Shennib
2001/0008560 A1 7/2001 Stonikas et al.
2001/0009019 A1 7/2001 Armitage
2001/0051775 A1 12/2001 Rho
2002/0015506 A1* 2/2002 Aceti ..... H04R 25/558 381/314
2002/0027996 A1 3/2002 Leedom et al.
2002/0085728 A1 7/2002 Shennib et al.
2003/0007647 A1 1/2003 Nielsen et al.
2003/0078515 A1 4/2003 Menzel et al.
2004/0028250 A1 2/2004 Shim
2004/0073136 A1 4/2004 Thornton et al.
2004/0136555 A1* 7/2004 Enzmann ..... H04R 25/43 381/314
2004/0165742 A1 8/2004 Shennib et al.
2005/0094822 A1 5/2005 Swartz
2005/0190938 A1 9/2005 Shennib et al.
2005/0226447 A1 10/2005 Miller, III
2005/0245991 A1 11/2005 Faltys et al.
2005/0249370 A1 11/2005 Shennib et al.
2005/0259829 A1* 11/2005 Van den Heuvel .... H04R 25/30 381/60
2005/0259840 A1 11/2005 Gable et al.
2005/0283263 A1 12/2005 Eaton et al.
2006/0094981 A1 5/2006 Camp
2006/0210090 A1 9/2006 Shennib
2006/0210104 A1 9/2006 Shennib et al.
2006/0291683 A1 12/2006 Urso et al.
2007/0019834 A1 1/2007 Nielson
2007/0071265 A1 3/2007 Leedom et al.
2007/0076909 A1 4/2007 Roeck et al.
2007/0189545 A1 8/2007 Geiger et al.
2007/0223721 A1 9/2007 Stern et al.
2007/0237346 A1 10/2007 Fichtl et al.
2008/0240452 A1 10/2008 Burrows et al.
2008/0273726 A1 11/2008 Yoo et al.
2009/0103764 A1 4/2009 Stiehl et al.
2010/0040250 A1 2/2010 Gerbert
2010/0119094 A1 5/2010 Sjursen et al.
2010/0145411 A1 6/2010 Spitzer
2010/0191143 A1 7/2010 Ganter
2010/0226520 A1 9/2010 Feeley et al.
2010/0239112 A1 9/2010 Howard et al.
2010/0268115 A1 10/2010 Wasden et al.
2010/0284556 A1 11/2010 Young
2011/0009770 A1* 1/2011 Margolis ..... A61B 5/121 600/559
2011/0058697 A1 3/2011 Shennib et al.
2011/0100127 A1 5/2011 Beck
2011/0176686 A1 7/2011 Zaccaria
2011/0188689 A1 8/2011 Beck et al.
2011/0190658 A1 8/2011 Sohn et al.
2011/0200216 A1 8/2011 Lee et al.
2011/0206225 A1 8/2011 Møller et al.
2011/0237103 A1 9/2011 Harlan et al.
2012/0051569 A1 3/2012 Blamey et al.
2012/0095528 A1 4/2012 Miller, III et al.
2012/0130271 A1* 5/2012 Margolis ..... A61B 5/123 600/559
2012/0157876 A1 6/2012 Bang et al.
2012/0177212 A1 7/2012 Hou et al.
2012/0177235 A1 7/2012 Solum
2012/0183164 A1 7/2012 Foo et al.
2012/0183165 A1 7/2012 Foo et al.
2012/0189140 A1 7/2012 Hughes
2012/0213393 A1 8/2012 Foo et al.
2012/0215532 A1 8/2012 Foo et al.

(56) References Cited

U.S. PATENT DOCUMENTS

| | | | | |
|---|---|---|---|---|
| 2012/0285470 | A9 | 11/2012 | Sather et al. | |
| 2012/0288107 | A1* | 11/2012 | Lamm ..... | H04R 25/30 381/59 |
| 2012/0302859 | A1 | 11/2012 | Keefe | |
| 2013/0010406 | A1 | 1/2013 | Stanley | |
| 2013/0177188 | A1 | 7/2013 | Apfel et al. | |
| 2013/0182877 | A1 | 7/2013 | Angst et al. | |
| 2013/0223666 | A1 | 8/2013 | Michel et al. | |
| 2013/0243209 | A1 | 9/2013 | Zurbruegg et al. | |
| 2013/0243227 | A1 | 9/2013 | Kinsbergen et al. | |
| 2013/0243229 | A1 | 9/2013 | Shennib et al. | |
| 2013/0294631 | A1 | 11/2013 | Shennib et al. | |
| 2014/0003639 | A1 | 1/2014 | Shennib et al. | |
| 2014/0150234 | A1 | 6/2014 | Shennib et al. | |
| 2014/0153761 | A1 | 6/2014 | Shennib et al. | |
| 2014/0153762 | A1 | 6/2014 | Shennib et al. | |
| 2014/0254843 | A1 | 9/2014 | Shennib | |
| 2014/0254844 | A1 | 9/2014 | Shennib | |
| 2015/0023512 | A1 | 1/2015 | Shennib | |
| 2015/0023534 | A1 | 1/2015 | Shennib | |
| 2015/0023535 | A1 | 1/2015 | Shennib | |
| 2015/0025413 | A1 | 1/2015 | Shennib | |
| 2015/0215714 | A1 | 7/2015 | Shennib et al. | |
| 2015/0256942 | A1 | 9/2015 | Kinsbergen et al. | |
| 2016/0066822 | A1 | 3/2016 | Shennib et al. | |
| 2016/0337770 | A1 | 11/2016 | Shennib | |
| 2016/0350821 | A1 | 12/2016 | Shennib et al. | |

FOREIGN PATENT DOCUMENTS

| | | | |
|---|---|---|---|
| JP | 2002191581 | A | 7/2002 |
| JP | 2005168856 | A | 6/2005 |
| JP | 2008109594 | A | 5/2008 |
| KR | 1020050114861 | A | 12/2005 |
| KR | 100955033 | B1 | 4/2010 |
| KR | 1020100042370 | A | 4/2010 |
| WO | 99/07182 | A2 | 2/1999 |
| WO | 2006136174 | A2 | 12/2006 |
| WO | 2010/091480 | A1 | 8/2010 |
| WO | 2011128462 | A2 | 10/2011 |
| WO | 2015009559 | A1 | 1/2015 |
| WO | 2015009561 | A1 | 1/2015 |
| WO | 2015009564 | A1 | 1/2015 |
| WO | 2015009569 | A1 | 1/2015 |

OTHER PUBLICATIONS

"Basic Guide to in Ear Canalphones", Internet Archive, Head-Fi.org, Jul. 1, 2012. Retrieved from http://web.archive.org/web/20120701013243/http:www.head-fi.org/a/basic-guide-to-in-ear-canalphones> on Apr. 14, 2015.

"dB HL—Sensitivity to Sound—Clinical Audiograms", Internet Archive, AuditoryNeuroscience.com, Apr. 20, 2013. Retrieved from <https://web.archive.org/web/20130420060438/http://www.auditoryneuroschience.com/acoustics/clinical_audiograms>on Apr. 14, 2015.

"Lyric User Guide", http://www.phonak.com/content/dam/phonak/b2b/C_M_tools/Hearing_Insstruments/Lyric/documents/02-gb/Userguide_Lyric_V8_GB_FINAL_WEB.pdf, Jul. 2010.

"Methods for Calculation of the Speech Intelligibility Index", American National Standards Institute, Jun. 6, 1997.

"Specification for Audiometers", American National Standards Institute, Nov. 2, 2010.

"The Audiogram", Internet Archive, ASHA.org, Jun. 21, 2012. Retrieved from <https:/web.archive.org/web/20120621202942/http://www.asha.org/public/hearing/Audiogram> on Apr. 14, 2015.

"User Manual—2011", AMP Personal Audio Amplifiers.

Abrams, , "A Patient-adjusted Fine-tuning Approach for Optimizing the Hearing Aid Response", The Hearing Review, Mar. 24, 2011, 1-8.

Amlani, et al., "Methods and Applications of the Audibility Index in Hearing Aid Selection and Fitting", Trends in Amplication 6.3 (2002) 81. Retrieved from <https://www.ncbi.nim.nih.gov/pmc/articles/PMC4168961/> on Apr. 14, 2015.

Asha, , "Type, Degree, and Configuration of Hearing Loss", American Speech-Language-Hearing Association; Audiology Information Series, May 2011, 1-2.

Convery, et al., "A Self-Fitting Hearing Aid: Need and Concept", http://tia.sagepubl.com, Dec. 4, 2011, 1-10.

Franks, "Hearing Measurements", National Institute for Occupational Safety and Health, Jun. 2006, 183-232.

Kiessling, , "Hearing aid fitting procedures—state-of-the-art and current issues", Scandinavian Audiology vol. 30, Suppl 52, 2001, 57-59.

Kryter, , "Methods for the calculation and use of the articulation index", The Journal of the Acoustical Society of America 34.11 (1962): 1689-1697. Retrieved from <http://dx.doi.org/10.1121/1.1909094> on Aug. 27, 2015.

Nhanes, , "Audiometry Procedures Manual", National Health and Nutrition Examination Survey, Jan. 2003, 1-105.

Sindhusake, et al., "Validation of self-reported hearing loss. The Blue Mountains hearing study", International Journal of Epidemiology 30.6 (2001 ): 1371-1378. Retrieved from <http://ije.oxfordjournals.org/content/30/6/1371.full> on Aug. 27, 2015.

Traynor, , "Prescriptive Procedures", www.rehab.research.va.gov/mono/ear/traynor.htm, Jan. 1999, 1-16.

World Health Organization, , "Deafness and Hearing Loss", www.who.int/mediacentre/factsheets/fs300/en/index.html, Feb. 2013, 1-5.

* cited by examiner

HEARING DEVICE TEST SYSTEM FOR NON-EXPERT USER AT HOME AND NON-CLINICAL SETTINGS

CROSS-REFERENCE TO RELATED APPLICATIONS

This application claims the benefit under 35 U.S.C. 119 of the earlier filing date of U.S. Provisional Application No. 62/100,876 entitled "HEARING DEVICE TEST SYSTEM FOR NON-EXPERT USER AT HOME AND NON-CLINICAL SETTINGS," filed Jan. 7, 2015. The aforementioned provisional application is hereby incorporated by reference in its entirety, for any purpose.

This application is related to U.S. Pat. No. 8,467,556, titled, "CANAL HEARING DEVICE WITH DISPOSABLE BATTERY MODULE," filed on Sep. 9, 2010; and U.S. Pat. No. 8,855,345, titled "BATTERY MODULE FOR PERPENDICULAR DOCKING INTO A CANAL HEARING DEVICE," filed on Mar. 19, 2012; and U.S. Pending patent application Ser. No. 14/011,620, titled, "HEARING PROFILE TEST SYSTEM AND METHOD," filed on Aug. 27, 2013; Ser. No. 14/011,581, titled, "INTERACTIVE HEARING AID FITTING SYSTEM AND METHODS," filed on Aug. 27, 2013; Ser. No. 14/011,607, titled "ONLINE HEARING AID FITTING SYSTEM AND METHODS FOR NON-EXPERT USER," filed on Aug. 27, 2013; and 62/047,607, titled "HEARING TEST SYSTEM FOR NON-EXPERT USER WITH BUILT-IN CALIBRATION AND METHOD," filed on Sep. 9, 2014; all of which are incorporated herein by reference in their entirety for any purpose.

TECHNICAL FIELD

Examples described herein relate to hearing devices, and more particularly methods and systems for performing a calibration process (e.g., a calibration check or a self-calibration) of a hearing device using a built-in calibration system of a hearing device test system.

BACKGROUND

The performance of a hearing aid may change over time due to degradation of components over time. A consumer may wish to ensure that their hearing aid is operating properly to optimize their hearing experience. Performance and calibration checks for hearing aids are typically performed by professionals using specialized test instruments, such as a hearing aid analyzer. These specialized test instruments are cumbersome due to size, cost, and nuances unneeded in the consumer environment. These nuances are not of interest to a consumer who merely wants a quick check to know if their hearing aid is properly operating within a specification. Hearing aid analyzers or calibration checkers for home use have been developed. However, these systems typically suffer from similar issues related to size, cost, and complexity and may not be generally suitable for administration by a hearing aid consumer in home settings.

Further, conventional hearing aid analyzers typically include costly components for performing an array of tests and scientific measurements well beyond the needs of a consumer for verifying the basic function of a hearing aid. For example, to maintain a high level of acoustic isolation, large insulated boxes are required leading to high manufacturing costs. In another example a standardized size acoustic cavity (known as acoustic couplers) is also used which adds considerable space and cost requirements. The combined cost of a typical hearing aid analyzer can easily exceed $3,000.

SUMMARY

A hearing device test system according to examples disclosed herein may include a hearing device, a portable test unit, and a processor. The hearing device may include a sound processor, a speaker, and a microphone.

The portable test unit may include a test microphone acoustically coupled to an exterior of the portable test unit via an acoustic calibration cavity. The acoustic calibration cavity may be defined by an acoustic chamber. The acoustic calibration cavity may be acoustically coupled to an exterior of the portable test unit. The test microphone may be configured to produce a calibration signal input responsive to acoustic calibration stimuli provided by the speaker. The portable test unit may include a coupler at an opening to the acoustic calibration cavity. The coupler may be configured to receive the hearing device or an acoustic adapter at least partially therein.

The processor may be associated with the hearing device test system. The processor may be incorporated within any of the portable test unit, computing device, or the hearing device. The processor may be configured to measure a level of the calibration signal input. The processor may be configured to validate the calibration of the hearing device. The processor may be configured to validate the calibration using a calibration data stored in any of a remote server, a client computer, the hearing device, and the portable test unit. The processor may be configured to validate the calibration by comparing a level of the calibration signal with a reference calibration level. The calibration may be confirmed if the level of the calibration signal input is within a range of reference levels.

In some examples, the hearing device test system may further include an acoustic adapter. The acoustic adapter may be configured for coupling a hearing device to the portable test unit. The acoustic adapter may include a first portion defining an opening configured to receive the different hearing device and a second portion comprising another opening configured to acoustically couple the hearing device to the acoustic calibration cavity.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof, including the best mode presently contemplated of practicing the invention, when taken in conjunction with the accompanying drawings, in which.

DETAILED DESCRIPTION

Certain details are set forth below to provide a sufficient understanding of embodiments of the invention. Some embodiments, however, may not include all details described. In some instances, well known structures may not be shown in order to avoid unnecessarily obscuring the described embodiments of the invention.

The present disclosure describes hearing device test systems and methods for checking a calibration of a hearing device test system or components thereof. A hearing device test system according to the present disclosure includes a portable test unit with a built-in calibration cavity. The hearing device test system may be particularly suitable for personal use, for example for use by a non-expert user outside the clinical environment. A hearing device test system according to some examples disclosed herein may mitigate the need for calibration check or calibration of a hearing device by a hearing professional or a service technician. Hearing device test systems as described herein may empower consumers to automatically check the performance and calibration of their hearing device at home, or generally non-clinical settings such as an office, a nursing home, a drug store, a pharmacy, etc. without resorting to cumbersome and costly instrumentation available in clinical settings. In some examples, a calibration of the hearing device may be checked automatically without resorting to sending some or all components of the hearing device test system (e.g., a hearing device) to the manufacturer or a service center for calibration or calibration check. In some examples, a programming of the hearing device may be automatically adjusted to recalibrate the hearing device after a calibration check.

Figure 1:
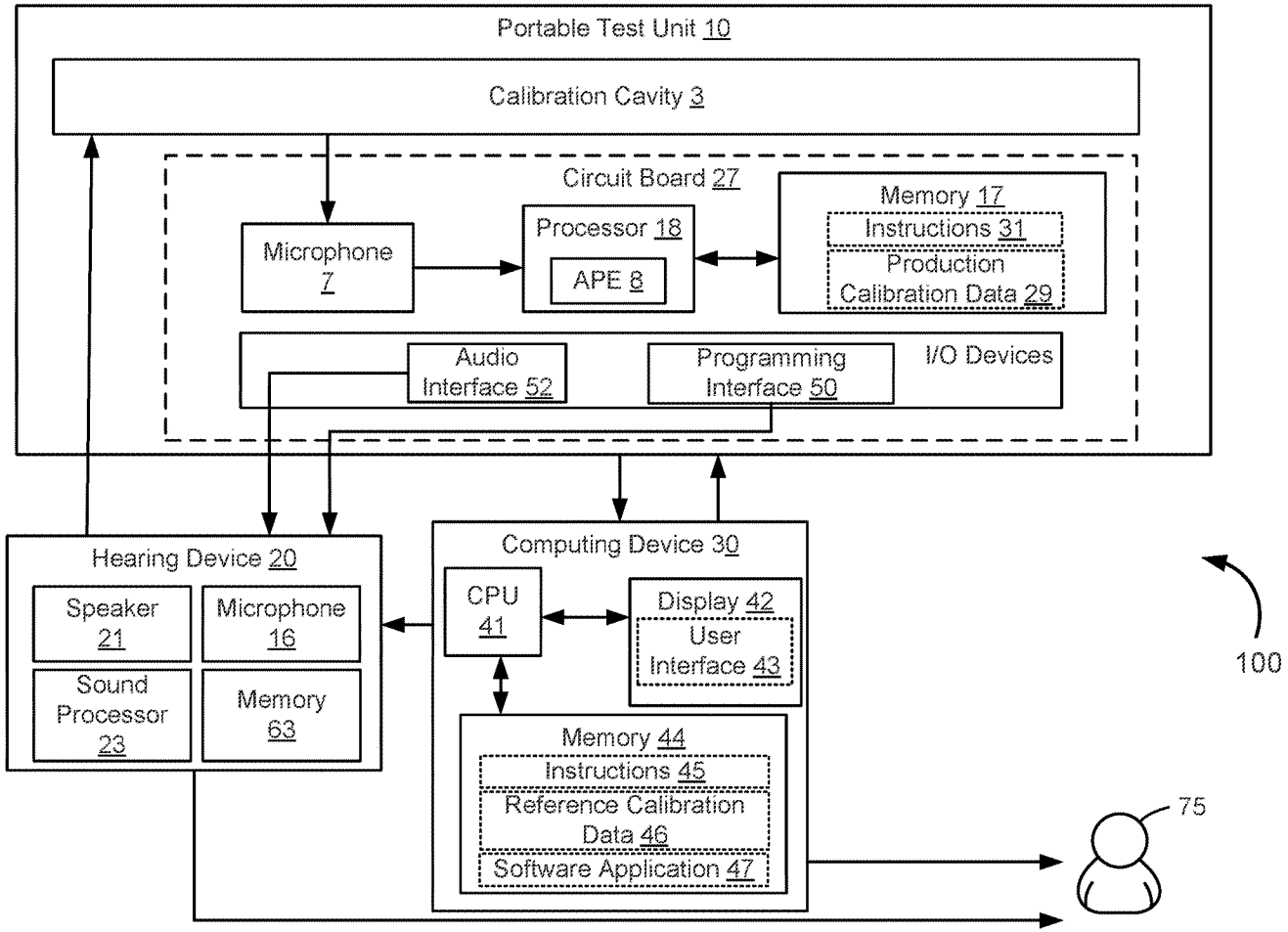
FIG. 1 is a block diagram of a hearing device test system according to examples of the present disclosure.
Figure 2:
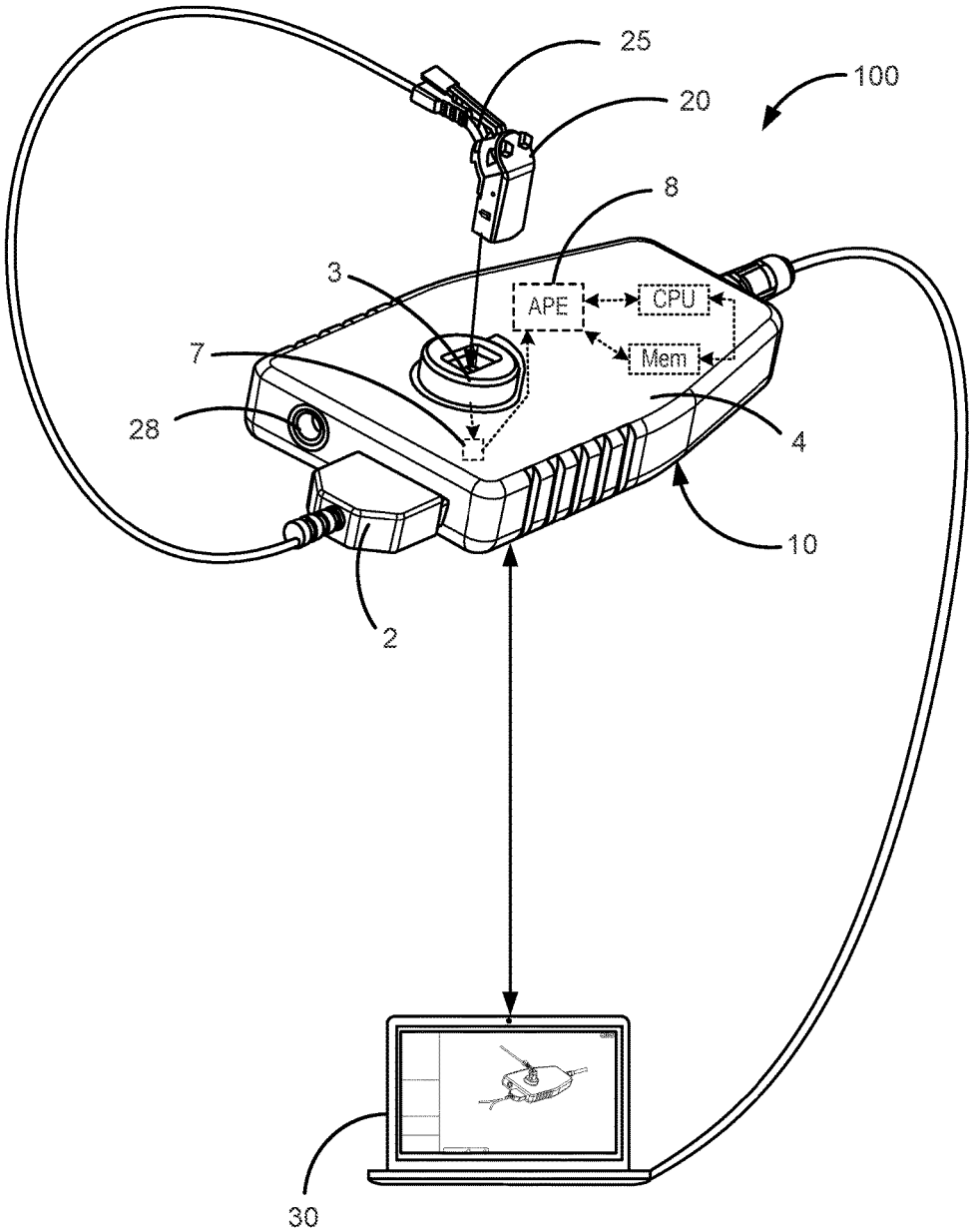
FIG. 2 is a view of a hearing device test system illustrating a portable test unit according to an embodiment and communicatively coupled to a hearing device and a computing device in accordance with the present disclosure.
Figure 8:
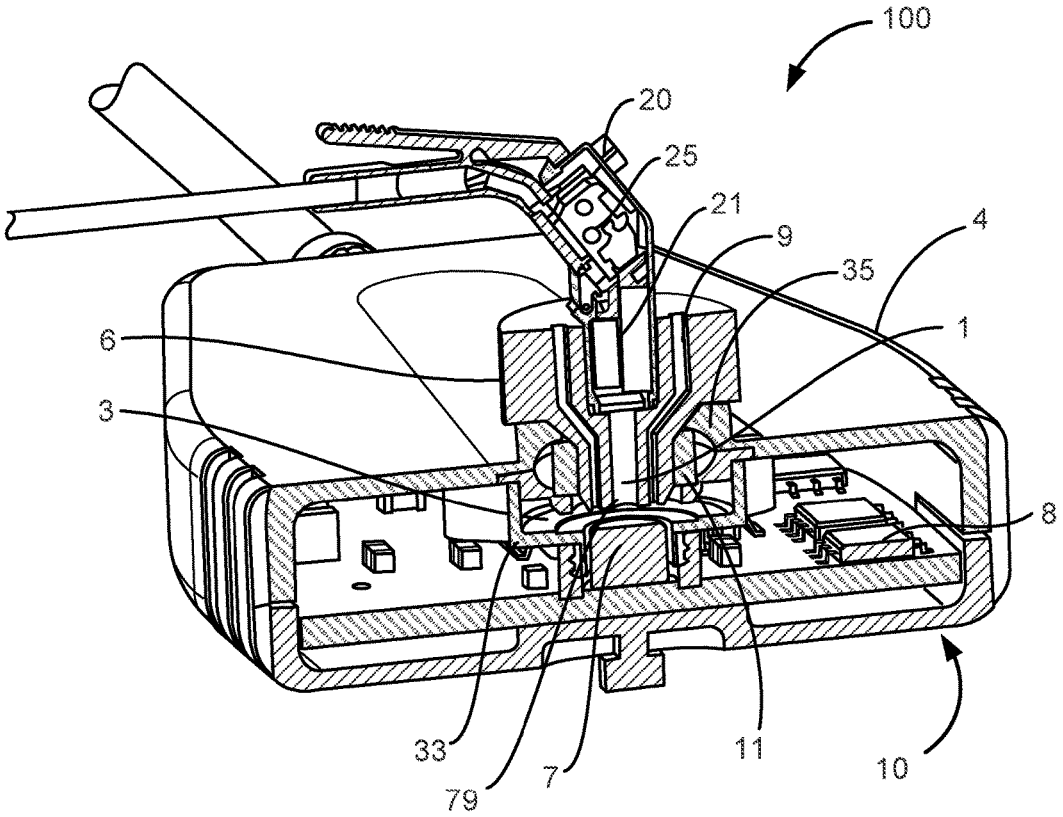
FIG. 8 is a cut-away view of a portable test unit with a hearing device acoustically coupled to the acoustic calibration cavity via an acoustic adapter, where the acoustic adapter includes a microphone calibration vent according to some examples.
Figure 9:
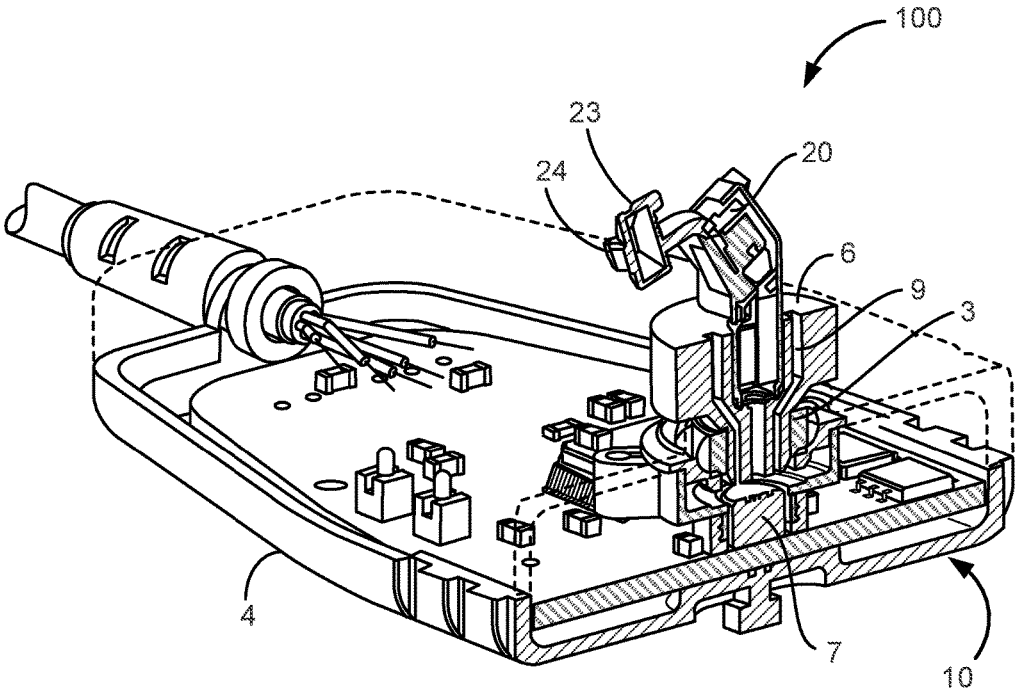
FIG. 9 is another cut-away view of a portable test unit with a hearing device coupled thereto via an acoustic adapter, according to some examples.
Figure 10:
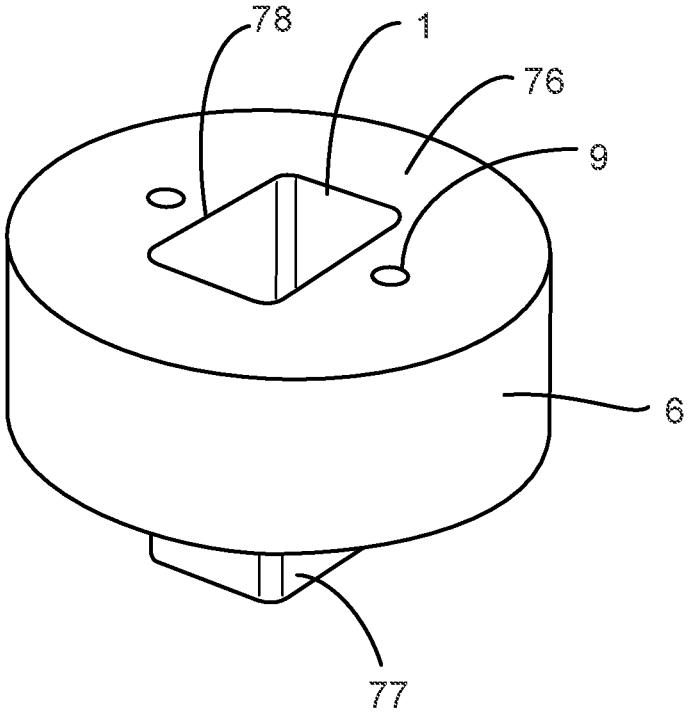
FIG. 10 is a view of an acoustic adapter for coupling a hearing device to a portable test unit, according to some examples.

FIGS. 1-10 illustrate hearing device test systems and components thereof according to examples of the present disclosure. FIG. 1 shows a block diagram of a hearing device test system 100 and FIGS. 2-6 show examples of the hearing device test system 100 in accordance with the present disclosure. The hearing device test system 100 includes a portable test unit 10 and a hearing device 20, and optionally a computing device 30. The hearing device test system 100 in FIGS. 7-9 includes a portable test unit 10 and a hearing device 20 substantially similar to those of the hearing device test system 100 and further includes an acoustic adapter 6 coupled to the portable test unit 10. FIG. 10 shows an acoustic adapter 6 according to one embodiment. The portable test unit 10, hearing device 20, and/or computing device 30 may be operatively coupled for performing a one or more calibration processes associated with the hearing device 20. Referring now to FIGS. 1-10, components and functionality of hearing device test systems according to the present disclosure will be further described.

Figure 4:
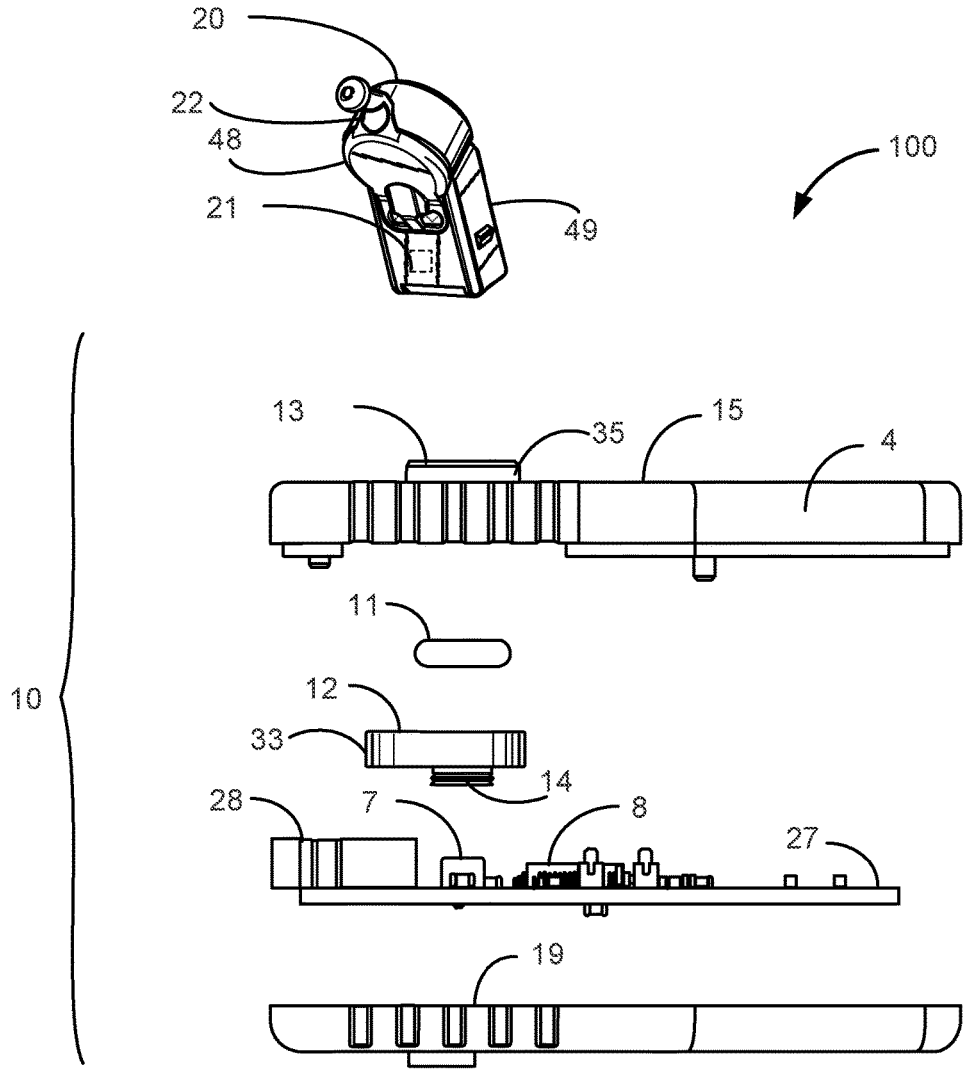
FIG. 4 is an exploded view of a portable test unit of a hearing device test system configured to couple to a modular hearing device according to some examples.

The hearing device 20 may be a hearing aid (BTE, CIC, or any other type), a personal sound amplification product (PSAP), or any other type of sound delivery device that may be worn by a consumer (e.g., user 75). The hearing device 20 may include a sound processor 23, a speaker 21 and a microphone 16. During typical use, the microphone 16 may detect acoustic inputs (e.g., ambient sounds) and transmit sound inputs to the sound processor 23, which may process (e.g., amplify) the sound inputs before transmission to the speaker 21 for delivery to the consumer. The sound inputs may be converted from analog to digital (e.g., using an A/D converter) before transmission to the sound processor 23 and then again from digital to analog (e.g., using a D/A converter) before transmission to the speaker 21. In some examples, the hearing device 20 may be modular (e.g., as shown in FIG. 4), including a battery module 48 and a main module 49. The main module 49 may contain electronic components such as the sound processor 23, speaker 21 and/or microphone 16. The battery module 48 may include a battery cell. The battery module 48 may partially or fully disengage from the main module 49, for example for recharging, replacement, or disposal of the battery cell. In some examples, the hearing device 20 may include a microphone port 22. The microphone port 22 may acoustically couple the microphone 16 to the ambiance. In some examples, the microphone port 22 may be provided in a lateral portion of the hearing device 20 (e.g., as shown in FIG. 4), while the microphone 16 may be provided in a medial portion of the hearing device 20. The medial portion of the hearing device 20 may be positioned within an ear canal when the hearing device 20 is worn by the consumer (e.g., user 75), and the microphone port 22 may acoustically couple the microphone 16 with the ambiance to receive sound inputs when the hearing device 20 is worn by the consumer. Performance of audio components of the hearing device 20 may degrade over time and a user may wish to perform a calibration check to determine whether the hearing device 20 is performing within specification. Systems and methods for performing a calibration check are described further below. In some examples, during a calibration check, as described herein, the microphone port 22 may enable delivery of test acoustic signals to the microphone 16 in order to provide a closed-loop test system as will be further described. In some examples, the hearing device 20 may include a calibration signal generator 24 for producing acoustic calibration stimuli 5 from the speaker 21, e.g., for use in a calibration of the hearing device 20 as will be further described.

The portable test unit 10 may be handheld or wearable. In some examples, a length of the portable test unit 10 may be less than 8 inches, less than 7 inches, less than 6 inches, less than 5 inches, or less than 4 inches. In some examples, the portable test unit 10 may be about 3 inches to about 6 inches long. In some examples, a width of the portable test unit 10 may be less than 5 inches, less than 4 inches, less than 2 inches, or less than 1 inch. In some examples, the portable test unit 10 may weigh less than 2 ounces. The portable test unit 10 may include electronic components enclosed, at least partially, by a housing 4. For example, the portable test unit 10 may include one or more circuit boards (e.g., circuit board 27) which may connect electronic components such as a microphone (e.g., test microphone 7), a processor (e.g., audio processing electronics 8, a processor 18 which may be programmed to perform functions described herein, or a combination of the two), input/output devices (e.g., an audio input/output device such as an audio jack 28, a USB port, or other types of ports of connectors 2), communication devices (e.g., Bluetooth or Wi-Fi enabled communication devices), and memory. The portable test unit 10 may include a wired or wireless programming interface 50 for programming the hearing device 20. In some examples, the programming interface 50 may be a wireless interface implemented in the form of a Bluetooth interface configured to communicatively couple the portable test unit 10 with the hearing device 20. In some examples, a wired audio interface 52 may provide functionality associated with the programming interface 50.

The portable test unit 10 may include an acoustic chamber 33 defining an acoustic calibration cavity 3. The acoustic calibration cavity 3 may be acoustically coupled to an exterior of the portable test unit 10 via an opening 13 provided in the housing 4. A test microphone 7 may be acoustically coupled to the exterior of the portable test unit 10 via the acoustic calibration cavity 3. For example, a sensor of the test microphone 7 may be provided within the acoustic calibration cavity 3 or along a wall of the acoustic calibration cavity 3 (see e.g., FIG. 8) in an operative arrangement to receive acoustic calibration stimuli 5 from the hearing device 20 when the hearing device is coupled to the acoustic calibration cavity 3. A coupler 35 may be provided at the opening 13 to the acoustic calibration cavity 3 for coupling the hearing device 20 thereto. The coupler 35 and/or acoustic calibration cavity 3 may be configured to receive the hearing device 20 or a portion thereof for receiving acoustic device calibration stimuli 5 from the hearing device 20. In some examples, the opening 13 may be shaped for a cooperating fit with the hearing device 20 and may function as the coupler 35. In some examples, the coupler 35 may be implemented in the form of a collar extending from a top portion 15 of the housing 4. The collar may be attached to or integral with the housing 4. The collar may define a passage which is shaped for a cooperating fit with the hearing device 20. In further examples, the coupler 35 may be shaped for a cooperating fit with an adapter (e.g., acoustic adapter 6) in order to accommodate hearing devices of different shapes, as will be described further e.g., with reference to FIGS. 7-10.

Figure 3:
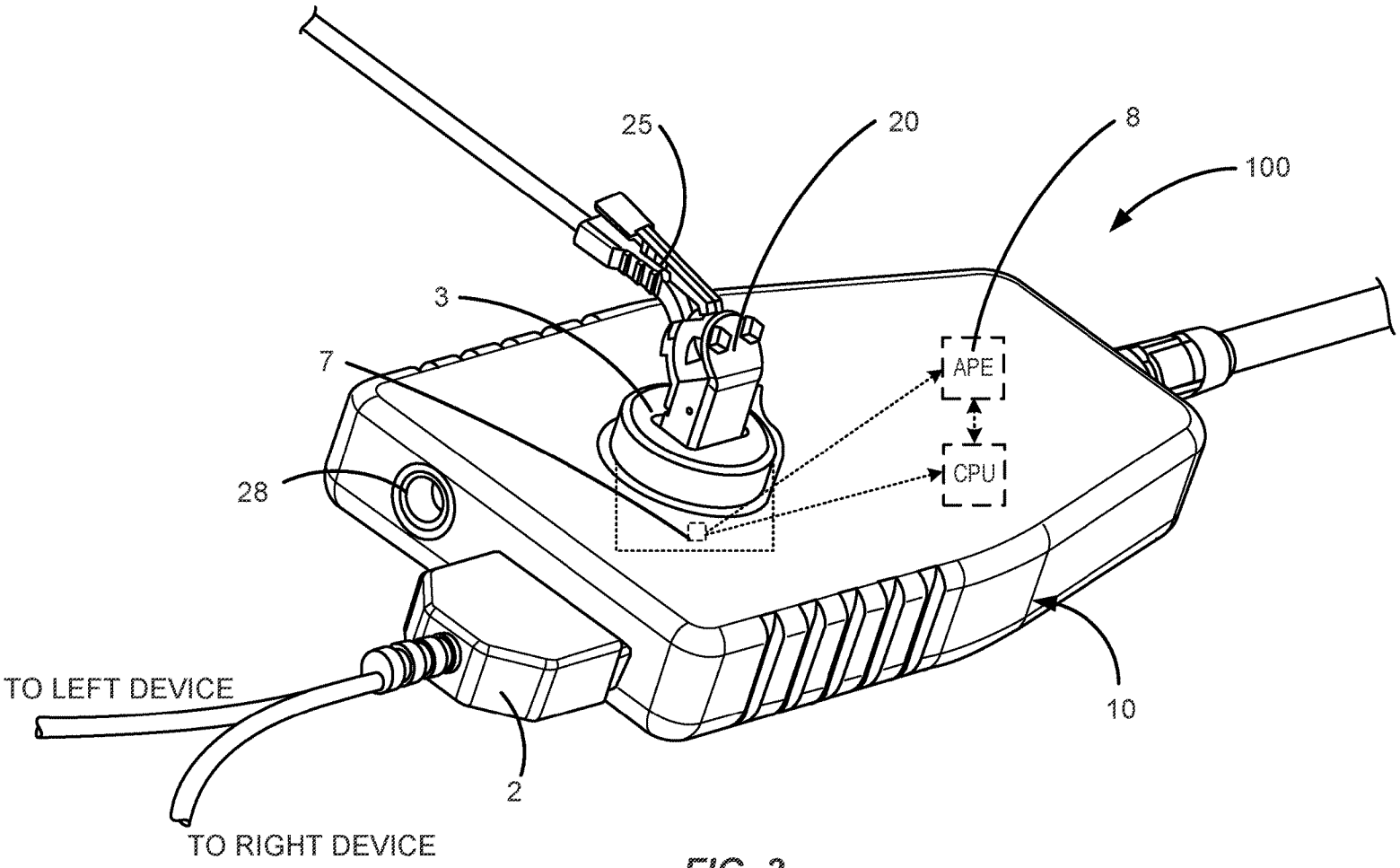
FIG. 3 is a partial view of a hearing device test system according to the present disclosure.

In some examples, the acoustic calibration cavity 3 may be configured to accommodate the hearing device 20 at least partially therein (e.g., as shown in FIG. 3). In some examples, the acoustic calibration cavity 3 may be configured to accommodate an acoustic adapter 6 (see e.g., FIGS. 7-10), which may enable differently sized and/or shaped hearing devices to be acoustically coupled with the acoustic calibration cavity 3. In some examples, the coupler 35 and/or acoustic calibration cavity 3 may be configured to accommodate an earpiece of a headphone for a hearing test at least partially therein. The coupler 35 may include holding features configured to engage the hearing device 20, or a hearing test earpiece or an acoustic adapter 6, for secure coupling with the hearing device 20, the hearing test earpiece, or the acoustic adapter 6. The holding features may be provided on the coupler 35 such that a consistent residual volume between the acoustic calibration cavity 3 and the end of hearing device 20, or earpiece or acoustic adapter 6, is maintained when the portable test unit is coupled with any of the hearing device 20, the earpiece, or the acoustic adapter 6. In some examples, the residual volume may be less than 0.5 $cm^3$. The acoustic calibration cavity 3 of portable test unit 10 may be used to perform a calibration process (e.g., a calibration check or a self-calibration) associated with the hearing device test system 100, as will be described in further detail below.

In some examples, the hearing device test system 100 may include a computing device 30, such as a personal computer, a smartphone, or a tablet. The portable test unit 10 may be communicatively coupled to the computing device 30. In some examples, the portable test unit 10 may be communicatively coupled to the computing device 30 using a wired or a wireless connection. For example, the computing device 30 may be coupled to the portable test unit 10 using a wired connection, such as USB connection. In some examples, the computing device 30 may be coupled to the portable test unit 10 using a wireless connection, such as Bluetooth. The wired or wireless connection may serve as a programming interface 50 or an audio interface 52 between the hearing device 20, portable test unit 10 and/or the computing device 30. In some examples, the wired or wireless connection between the computing device 30 and the portable test unit 10 may enable programming of the hearing device 20 when coupled to the portable test unit 10.

The computing device may include a processor (CPU) 41 which may be configured to execute a standalone calibration test application (e.g., software application 47). In some examples, the calibration test application may be a web-based application. The computing device 30 may include memory 44 which may store processor-executable instructions 45, which may program the processor 41 to execute the software application 47. The processor-executable instructions 45 may include instructions for performing a calibration check or a self-calibration using the portable test unit 10. In some examples, the computing device 30 may store or relay calibration data (e.g., reference calibration data 46) for performing the calibration check and/or the self-calibration. The term calibration check may refer to a process for verifying that the hearing device 20 is within a reference calibration range with a pass/fail result. The term self-calibration may refer to a process for determining whether the hearing device 20 is within the reference calibration range, and adjusting calibration data of the hearing device 20 to recalibrate the hearing device 20 if the hearing device 20 is determined to be outside the reference calibration range. The calibration data of the hearing device 20 may be stored in memory of the hearing device 20 (e.g., memory 63) and may be used by the hearing device 20 to produce an audible output based on an input signal. For example, an input signal may be generated by the microphone 16 of the hearing device 20 in response to detecting an audible input (e.g., ambient sound). The input signal from the microphone 16 may be processed (e.g., amplified) by the sound processor 23 to produce an output at the speaker 21, as previously described, which may include adjusting the output in accordance with the calibration data of the hearing device 20.

The portable test unit 10 includes an acoustic calibration cavity 3 for receiving acoustic calibration stimuli 5 from the hearing device 20. The acoustic calibration cavity 3 may be configured for coupling the hearing device 20 therewith, for example by inserting at least a portion of the hearing device 20 within an opening of the calibration cavity 3 (e.g., an inlet of calibration cavity 3). In some examples, during a calibration check or a self-calibration, the speaker 21 of the hearing device 20 may be positioned within the acoustic calibration cavity 3. During the calibration check or self-calibration, the speaker 21 of the hearing device 20 may be oriented toward a test microphone 7 within the calibration cavity of the portable test unit 10. The test microphone 7 may also measure ambient sounds during a hearing test. The test microphone 7 of the portable test unit 10 may be provided within the acoustic calibration cavity 3 for receiving the acoustic calibration stimuli 5 during a calibration check or a self-calibration function. In some examples, the test microphone 7 may be provided at a bottom of the acoustic calibration cavity 3. During a calibration check or a self-calibration, the test microphone 7 may produce a calibration signal input in response to acoustic calibration stimuli 5 generated by the speaker 21 of the hearing device 20. The test microphone 7 may transmit the calibration signal input to an audio processing electronics 8 (APE) of the portable test unit 10.

In some examples, a removable ear sealing retainer (not shown) of the hearing device 20 is removed from the hearing device 20 prior to inserting the hearing device 20 into the acoustic calibration cavity 3. When the hearing device 20 is accommodated within the acoustic calibration cavity 3, the speaker 21 of the hearing device 20 may transmit an acoustic calibration stimuli 5 to the acoustic calibration cavity 3. In some examples, the portable test unit 10 may include a speaker within the acoustic calibration cavity 3 for delivering an acoustic calibration stimuli for receiving by the hearing device microphone 16. The acoustic calibration cavity 3 may be configured with a controlled acoustic volume to produce a predetermined sound pressure level according to the acoustic calibration stimuli 5. In some examples, the speaker 21 of the hearing device 20 and the test microphone 7 of the portable test unit 10 may be oriented to face each other when the hearing device 20 is placed within the acoustic calibration cavity 3. The test microphone 7 may alternatively be positioned indirectly or sideways with respect to the speaker of the hearing device 20. In some examples, the acoustic calibration cavity 3 may include a locking mechanism for secure attachment of the hearing device 20 when placed within. The acoustic calibration cavity 3 provides a controlled acoustic transfer function for the hearing device 20 when inserted therein.

Referring now further to FIGS. 7-10, the hearing device test system 100 may include an acoustic adapter 6. The acoustic adapter 6 may be configured for coupling a hearing device which may be differently shaped from the hearing device 20. In some examples, the portable test unit 10 may be configured to couple to an earpiece of a hearing test system and an acoustic adapter 6 may be used to couple the hearing device 20 to the calibration cavity 3 of the portable test unit 10. The acoustic adapter 6 may include a first portion 76 defining a first opening 78 for coupling to the hearing device 20 and a second portion 77 defining a second opening 79 to acoustically couple the hearing device 20 to the acoustic calibration cavity 3, as shown in FIGS. 8-10. The first portion 76 may include a cavity shaped to at least partially accommodate the medial (inner) end of the hearing device 20. The first portion may include holding features for securing the hearing device 20 thereto. The second portion 77 may be designed and shaped to secure the acoustic adapter 6 to the calibration cavity 3. The second portion 77 may include features configured to engage with the coupler 35 and/or opening 13 of the acoustic calibration cavity 3. An acoustic channel 1 may extend between the first and second openings 78, 79 for delivery of acoustic signals through the acoustic adapter 6. The acoustic channel 1 or an output thereof (e.g., second opening 79) may be aligned with a speaker port of the hearing device 20 when the hearing device 20 is inserted into the acoustic adapter 6 so as to allow acoustic signals 5 generated by the speaker 21 of the hearing device 20 to travel through the acoustic channel 1 into the acoustic calibration cavity 3. The acoustic calibration stimuli 5 may be transmitted from the hearing device 20 provided in the first opening 78 of the acoustic adapter 6 to the acoustic calibration cavity 3 via the second opening 79 of the acoustic adapter 6. The acoustic adapter 6 may be manufactured from any material suitable for coupling with the hearing device 20 and the portable test unit 10 to deliver acoustic signals, for example plastic or rubber. In some examples, the acoustic adapter 6 may be mass producible using an injection molding manufacturing process.

In some examples, the acoustic adapter 6 may include a microphone calibration vent 9 to deliver test sound from the acoustic calibration cavity 3 back to the microphone 16 of the hearing device 20. Delivery of test acoustic signals from the acoustic cavity to the microphone 16 of the hearing device 20 may provide a closed-loop system whereby an acoustic output 5 from the speaker 21 of the hearing device 20 may be received by the microphone 16 of the hearing device 20 via a microphone port 22 (FIG. 4) provided on a lateral end of the hearing device 20 to perform a calibration check on the microphone 16 within the hearing device 20. The test audio signals may correspond to sound segments of varied sound levels and frequency characteristics, as known in the art of hearing aid testing and calibration. A level of the test signal input may be measured by the hearing device 20 and/or the computing device 30 and compared to a reference level to determine if the microphone 16 of the hearing device 20 is functioning within a calibration range, for example within 3 dB of the reference level.

In some examples, the microphone calibration vent 9 may be incorporated within a housing of the acoustic calibration cavity 3, or the acoustic adapter 6. The microphone port 22 may be provided on the lateral end of the hearing device 20 to receive acoustic calibration stimuli. The acoustic calibration stimuli may include acoustic calibration stimuli 5 generated by the speaker 21 of the hearing device 20 or a different acoustic calibration stimuli generated by a speaker incorporated within the acoustic calibration cavity 3 of the portable test unit 10. In some examples, the acoustic adapter 6 may be formed to provide the calibration vent opening 19 in alignment with the microphone port 22 of the hearing device 20. In some examples, the microphone vent opening 19 may be provided at a predefined orientation and distance from the microphone port 22 of the hearing device 20 to provide a predetermined acoustic transfer function, for example a predefined acoustic loss. The predefined acoustic characteristics may be accounted for during calibration check or calibration of the hearing device 20.

In some examples, the acoustic adapter 6 may include multiple microphone calibration vents so as to allow the hearing device 20 to be inserted into the acoustic adapter 6 in multiple orientations. In some examples, two or more microphone calibration vents may be provided.

In some examples, a test pod 25 may house a test speaker (not shown) for transmitting a calibration acoustic signal to the microphone 16 of the hearing device 20. The test pod 25 may be shaped to couple to the hearing device 20. The microphone 16 of the hearing device 20 may produce an input signal in response to the calibration acoustic signal from the test pod 25. The microphone 16 may deliver the input signal to the sound processor 23 of the hearing device 20 and ultimately producing acoustic calibration stimuli 5 from the speaker 21 based on the input calibration acoustic signal. The test pod 25 may be coupled to the computing device 30 or the portable test unit 10 via a wired or wireless interface.

Figure 5:
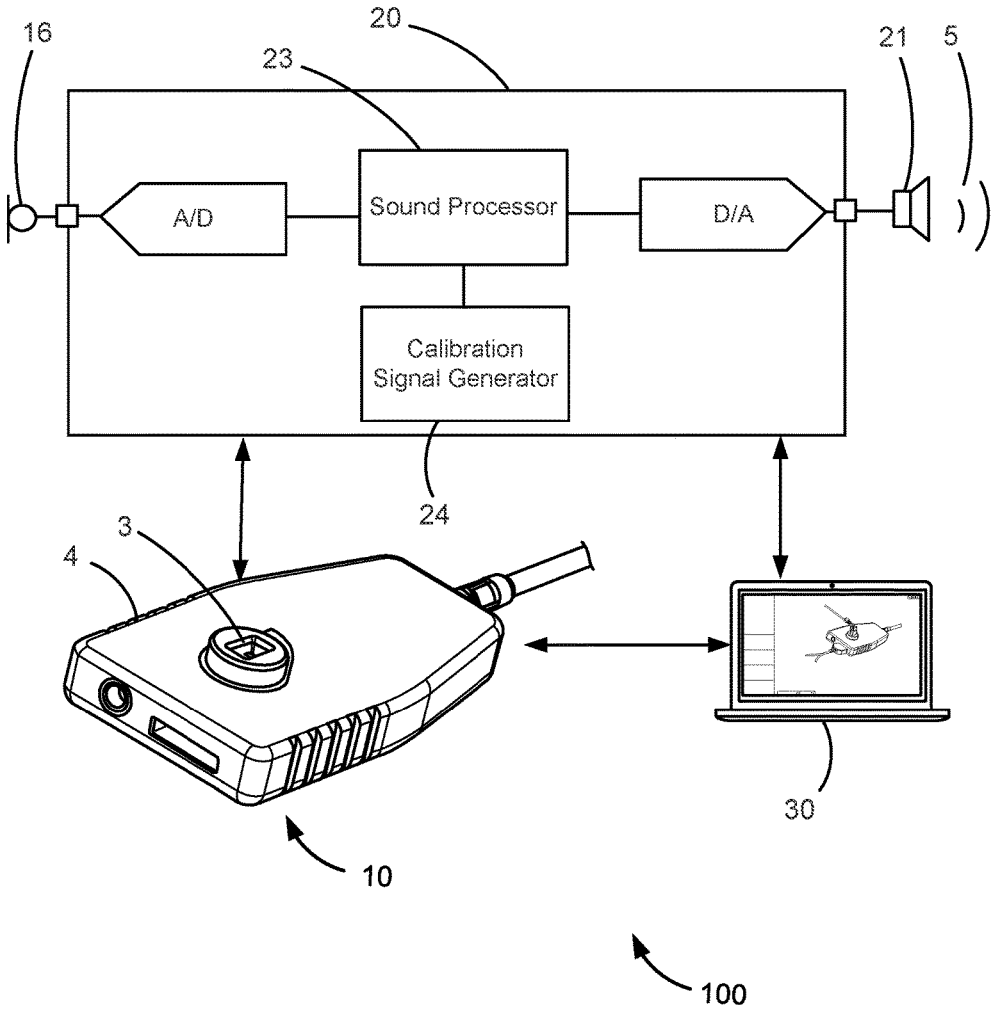
FIG. 5 is an illustration of a closed-loop system for performing a calibration process association with a hearing device test system according to some examples
Figure 6:
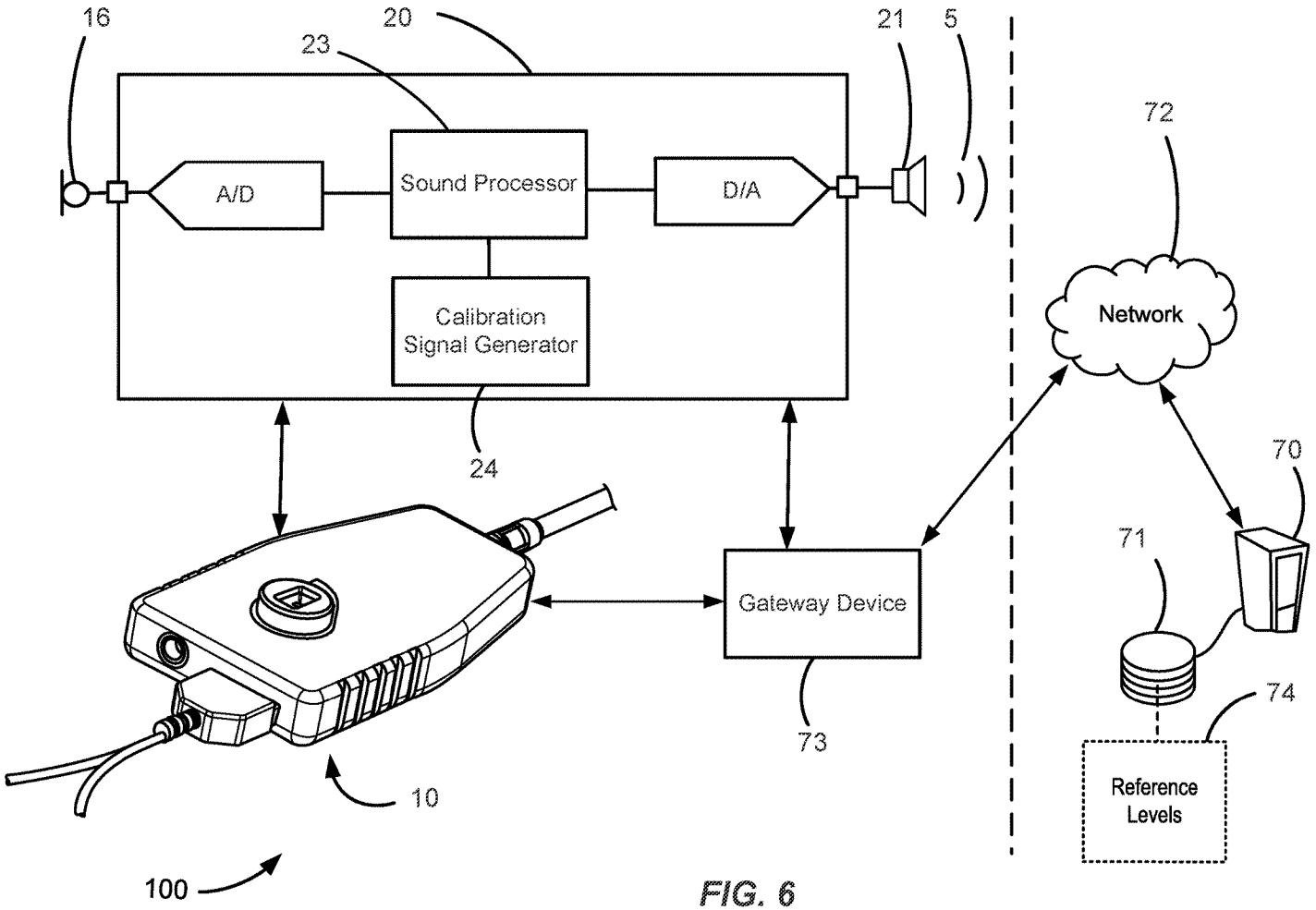
FIG. 6 is an illustration of a network-enabled hearing device test system according to some examples.
Figure 7:
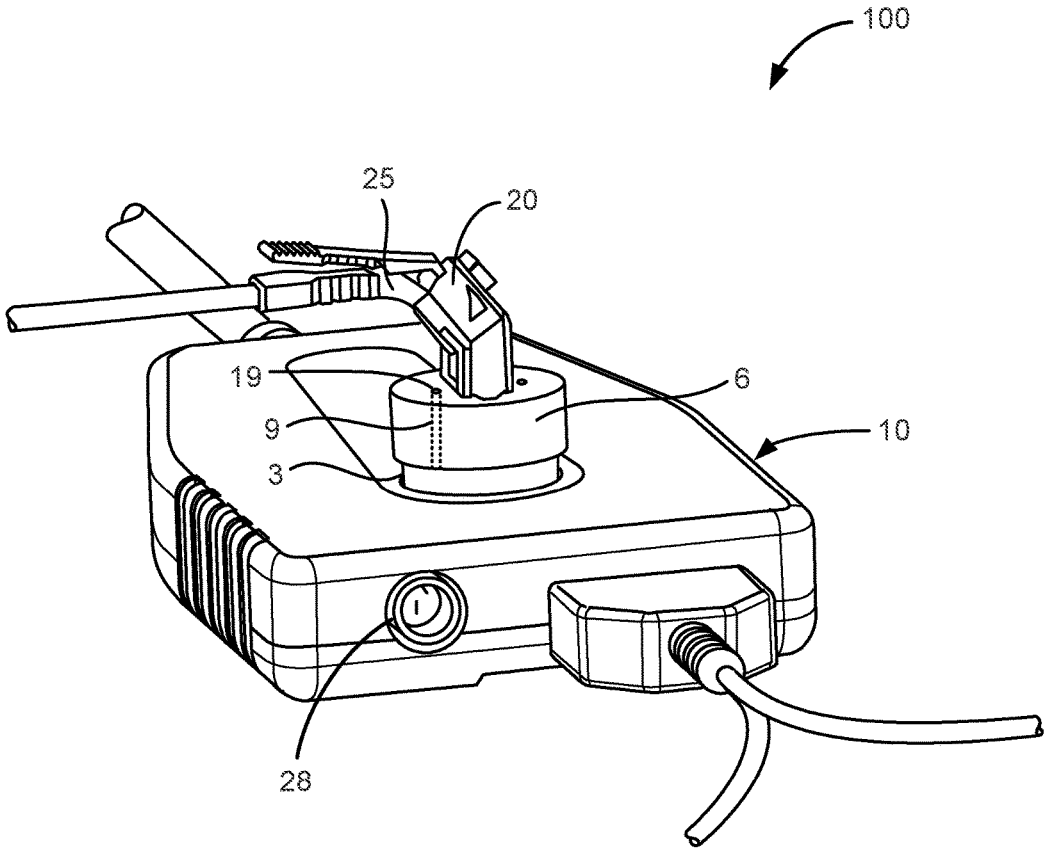
FIG. 7 is a view of a portable test unit with a hearing device coupled thereto via an acoustic adapter according to some examples.

In some examples, the hearing device 20 may include a calibration signal generator 24 for producing acoustic calibration stimuli 5 from the speaker 21 of the hearing device 20, as shown in FIGS. 5 and 6. The calibration signal generator 24 may receive a request to generate an acoustic calibration stimuli 5. The request may be generated by the portable test unit 10 or a computing device 30. In some examples, the calibration signals may include discrete signals of specific frequency and level. The calibration signal generator 24 may deliver a composite calibration stimuli comprising multiple frequencies.

In some examples, the calibration of the hearing device 20 may be validated by coupling the hearing device 20 to the acoustic calibration cavity 3, as described above. When the hearing device 20 is inserted into the acoustic calibration cavity 3, the portable test unit 10 or the computing device 30 may transmit a command to the hearing device 20 to produce acoustic calibration stimuli 5. The acoustic pressure produced in the acoustic calibration cavity 3 may be sensed by the test microphone 7 of the portable test unit 10, which may transmit a calibration signal input to the audio processing electronics 8 and/or a processor (e.g., processor 18 of the portable test unit 10, or processor 41 of computing device 30), to validate the calibration of the hearing device 20. In some examples, the calibration data may be automatically adjusted according to the measured response and the analysis of the acoustic calibration stimuli 5 produced within the calibration cavity 3. In some examples, the audio processing electronics 8 may be integrated into a single integrated circuit (IC) which includes the functionality of a CPU, an analog-to-digital (A/D) converter, and a digital-to-analog (D/A) converter.

The calibration data may be adjusted to correct for a difference between an acoustic level generated by the hearing device 20 in response to a calibration signal input and a reference level. The calibration data may be stored in memory within the hearing device 20, portable test unit 10 (e.g., production calibration data 29) or in the memory of an external device, for example the computing device 30 or a remote database 71. The calibration data may include reference data produced initially at the factory. The audio processing electronics 8 may be in communication with I/O circuitry, for example a wireless bus or a USB bus. The audio processing electronics 8 may receive a calibration signal input produced by the test microphone 7. The calibration signal input produced by the test microphone 7 may be in response to receiving acoustic calibration stimuli 5 produced by the speaker 21 of the hearing device 20 when placed within the calibration cavity. In some examples, the portable test unit 10 including the calibration cavity 3 may be configured to perform a home calibration check for either a hearing test earphone or for a hearing device 20, or for both.

The audio processing electronics 8 may be in communication with a processor 41 of a computing device 30 (for example, a personal computer) to measure a level of the calibration signal input, representative of the level of acoustic calibration stimuli 5 produced in the calibration cavity 3. The processor 41 may validate the calibration of the hearing device 20 using calibration data, which may be stored in the hearing device 20 or a remote database 71. The validation may occur by comparing the level of a measured calibration stimuli 5, or a signal represented thereto, to a reference level. The measured level of the calibration signal input may be validated if the measured level is within an acceptable range, for example within 3 dB of the reference level. If the measured level of the calibration signal input for a particular frequency is validated, the processor continues to check the calibration at other frequencies until all audiometric frequencies of interest are validated. Alternatively, calibration stimuli may be a composite signal, or wide spectrum noise, representing the range of audiometric frequencies of interest. If the measured level of the calibration stimuli is found to be outside an acceptable range, the processor 41 may adjust the calibration data to compensate for out-of-range calibration. In some examples, the calibration check may indicate an acceptable change in electroacoustic characteristics of the speaker 21 or the microphone 16, or a more serious change requiring the hearing device 20 to be replaced, or sent to the manufacturer or a service center for inspection or recalibration. A failed device calibration check may be indicative of a damaged hearing device 20, for example a defective speaker 21 or microphone 16.

In some examples, out-of-range calibration measurements (e.g., measurements that deviate from the reference level outside of the accepted range) may be automatically adjusted for to recalibrate the hearing device 20. An adjustment to the calibration data may be a corrective measure to account for a difference between the measured level of the calibration signal input and an expected level defined in the software application. The difference may be minor or major depending on the cause. The hearing device 20 may be re-programmed with the adjusted calibration data.

FIG. 4 is an exploded view of a portable test unit 10 which may be configured to receive hearing device 20 for performing a calibration check of the hearing device 20, according to some examples. The portable test unit 10 may include a housing 4 that encapsulates electronic circuitry within, such as a circuit board 27, audio processing electronics 8, and a test microphone 7. The housing 4 may be formed from plastic and manufactured using an injection molding process. The housing 4 may include a top housing component 15 joined to a bottom housing component 19 by adhesive, snapping, screws, or any known fastening mechanism or technique. An acoustic chamber 33 may be provided at least partially between the top and bottom housing components 15. A first opening 13 may be provided in the top housing component 15 (thus interchangeably referred to as a top opening 13) for acoustically coupling the acoustic calibration cavity 3 to an exterior of the housing 4. The top opening 13 may be circular, semi-circular, rectangular, or any other shape to match the shape and size of the medial end of the hearing device 20. In some examples, the top opening 13 may be provided in a coupler 35 which may include lead-in features to facilitate insertion of the hearing device 20 and an acoustic seal to facilitate acoustic sealing of the hearing device 20 when coupled to the acoustic calibration cavity 3. In some examples, an acoustic seal (e.g., a sealing ring 11) may be provided at the opening 13 or along the passage defined by the coupler 35 to provide an acoustically controlled interface between the hearing device 20 and the acoustic calibration cavity 3. The acoustic calibration cavity 3 may be defined by walls 12 of the acoustic chamber 33 to provide an acoustic chamber of predefined size and shape. The acoustic calibration cavity 3 may be shaped and sized to provide a controlled acoustic transfer function between the hearing device output and test microphone 7. The acoustic calibration cavity 3 may be sized and shaped for partial insertion of the hearing device 20 within. The acoustic chamber 33 may include a second opening 14 to acoustically couple the calibration cavity 3 with the test microphone 7. The second opening 14 may be interchangeably referred to as microphone port 14. In some examples, the second opening 14 may be provided along a bottom portion of the acoustic chamber 33 and may in such examples be referred to as bottom opening. An acoustic seal may be provided around the microphone port 14. A vent may be provided between the exterior of the housing and the acoustic cavity 3 to provide pressure relief during insertion of the hearing device 20 into the calibration cavity 3. The acoustic seal associated with coupler 35 and/or the test microphone 7 may be an O-ring type seal, made of compliant rubber material. Sealing of the microphone port 14 may also be achieved by the use of a sealing adhesive.

FIGS. 8 and 9 show sectional views of a portable test unit 10 with a hearing device coupled thereto, according to some examples. Circuitry of the portable test unit 10 is provided within the housing 4. The circuitry typically includes analog and digital circuit components in the form of an integrated circuits along with discrete components. The portable test unit 10 may include connecting ports, for example an audio jack 28 for a hearing test headphone and a communications port implementing a programming interface 50 and/or an audio input interface 52. In some examples, the portable test unit 10 may be connected to a computing device 30 by a USB connection. In some examples, the portable test unit 10 may include wireless connectivity circuitry, for example a Bluetooth integrated circuit and antenna.

A hearing device test system (e.g., hearing device test system 100) may be calibrated according to the examples herein. The hearing device test system 100 disclosed herein eliminates costly calibration checks, or recalibration, typically performed at the manufacturer site, or by a calibration technician in clinical settings. The hearing device test system 100 may allow for a calibration check of the hearing device 20 at home or non-clinical setting by a non-expert user, simply by inserting the hearing device 20 into the calibration cavity 3 and initiating a calibration check by a software application. In some examples, the calibration check may be initiated by activating a switch provided on the portable test unit 10 or the hearing device 20. In some examples, the calibration check sequence is rapid and takes less than 30 seconds. In some examples, tones at 500, 1,000, 2000 and 4,000 Hz may be produced and the calibration measurement may be compared with stored calibration data. In some examples, a composite signal including multiple frequencies may be produced and the calibration measurement may be compared with stored input calibration data at each frequency of interest. In some examples, the device calibration data may be adjusted to yield a calibration measurement within a calibration range. This self-contained calibration system eliminates the needs for specialized calibration instruments such as a sound level meter, an acoustic coupler, and sound level calibrator unit. The cost of these specialized instruments may be thousands of dollars, compared to the cost of under $100 for the hearing device calibration check system disclosed herein.

During a calibration check or during a self-calibration, hearing device 20 may receive a calibration signal to cause hearing device 20 to generate an acoustic calibration stimuli for conducting a calibration check or self-calibration of the hearing device 20. The hearing device 20 may produce an acoustic calibration stimuli 5 by audio streaming test signals from the computing device 30. The speaker 21 of the hearing device 20 may produce an acoustic calibration stimuli 5 in response to the calibration signal received from the computing device 30. In some examples, the hearing device 20 may produce an acoustic calibration stimuli 5 in response to the calibration signal received from the portable test unit 10. In other examples the acoustic calibration stimuli 5 is generated by the hearing device 20 from a calibration signal generator 24. The calibration signal may be generated based on calibration data (e.g., production calibration data 29) stored in memory. The hearing device 20 may be coupled to any of the computing device 30 and the portable test unit 10 for receiving the calibration signal or the request to generate it internally (e.g., using calibration signal generator 24) via a wired or wireless connection. The production calibration data 29 may be adjusted according to reference calibration data 46 stored in memory, as shown in FIG. 1, such that the acoustic calibration stimuli produced by the hearing device 20 is ensured to be within a reference calibration level range defined by reference levels of the reference calibration data 46. The memory may be associated with the hearing device test system 100, for example memory 17 within the portable test unit 10, memory 44 of the computing device 30, memory 63 of the hearing device 20 or memory of a remote server 70.

In some examples, individual components of the hearing device 20 may be isolated and checked separately to ascertain a cause of a failed validation of the hearing device. For example, the speaker 21 and sound processing electronics of the hearing device 20 may be checked in isolation by requesting delivery of an acoustic calibration stimuli 5. The microphone 16 of the hearing device 20 may be bypassed or disabled while the speaker 21 and sound processing electronics are being checked. A first signal level associated with the acoustic calibration stimuli in the acoustic calibration cavity may be measured by the test microphone 7 provided within the acoustic calibration cavity 3. A calibration of the hearing device speaker 21 may be validated by comparing the first signal level measured and a first reference level stored in a memory.

The functionality of the microphone 16 of the hearing device 20 may be checked in isolation by transmitting an acoustic test input to the hearing device 20. The acoustic test input may be the acoustic calibration stimuli 5 produced by the hearing device speaker 21, or by a speaker within the portable test unit 10. A second signal level may be measured by the hearing device microphone 16. In some examples, the acoustic calibration stimuli 5 may be delivered to the hearing device microphone 16 via a microphone calibration vent 9 that acoustically couples the calibration cavity 3 and the hearing device microphone 16. A functionality or calibration of the hearing device microphone 16 may be validated by comparing the second signal level measured and a second reference level stored in the memory. In some examples, the hearing device speaker 21 may be validated first before validating the hearing device microphone 16.

In some examples, the hearing device test system 100 may include a hearing aid fitting system. The hearing aid fitting system may request the hearing device 20 to produce a test output in-situ corresponding to predetermined input levels for a programmable hearing device 20. The hearing evaluation/fitting system may also include a programming interface 50 for interactively transmitting programming signals to the hearing device 20 in-situ. The fitting method may generally involve instructing the consumer to listen to the output of the hearing device 20 in-situ and to adjust fitting parameters interactively according to the subjective assessment of the consumer to the output delivered by the hearing device 20 in-situ. The fitting method may be implemented using a user interface 43 shown on a display 42 of the computing device 30. The user interface 43 of the fitting method may be configured to allow the consumer to respond and adjust hearing device parameters in perceptual lay terms, such as volume, loudness, audibility, clarity, and the like, rather than technical terms and complex graphical tools conventionally used by hearing professionals in clinical settings.

In some examples, the hearing device test system 100 may be in communication with a remote server 70 for an online calibration check, as shown in FIG. 6. In some examples, the hearing device test system 100 may include a gateway device 73 that is in communication with the remote server 70 via a network 72, for example the Internet. The gateway device 73 may include a client computer, a node of a mesh network, and/or any device with network connectivity. The remote server 70 may be configured to retrieve data from a remote database 71. The remote database 71 may store hearing device data including reference levels 74 associated with the calibration check or self-calibration. In some examples, the remote server 70 may be connected to a computing device associated with customer support. It may be advantageous for a consumer to be in communication with customer support during the online calibration check to utilize an expertise of a remotely located customer support representative without requiring the consumer to leave their home. Furthermore, a consumer may desire to be in communication with customer support in order to remotely administer the calibration check. When in communication, the remote server 70 may control and/or access the hearing device 20 and the hearing device test system 100.

Figure 11:
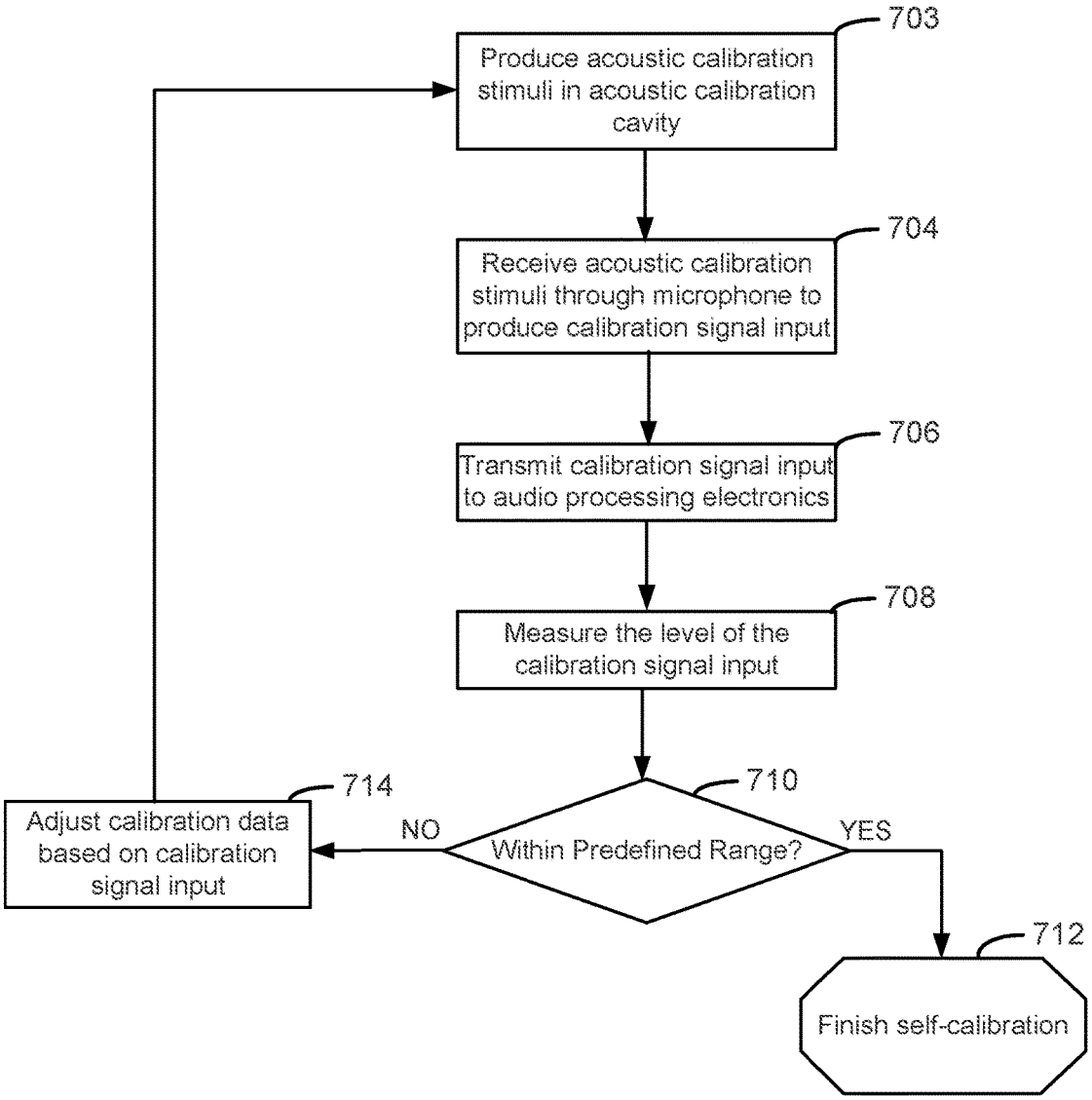
FIG. 11 is a flow chart representation for a calibration of a hearing device using a hearing device test system, according to some examples.

FIG. 11 is a flow chart representation for a calibration of the hearing device using the calibration cavity and the sound pressure measurement, according to some examples. While the various steps in this flowchart are presented and described sequentially, one of ordinary skill will appreciate that some or all of the steps can be executed in different orders and some or all of the steps can be executed in parallel. Further, in one or more embodiments, one or more of the steps described below can be omitted, repeated, and/or performed in a different order. Accordingly, the specific arrangement of steps shown in FIG. 11 should not be construed as limiting the scope of the invention.

In step 703, an acoustic calibration stimuli 5 is produced in the acoustic calibration cavity 3. The acoustic calibration stimuli 5 is sensed by the test microphone 7 provided within the acoustic calibration cavity 3. A remote server 70 may be accessed to retrieve reference calibration data. In step 704, the acoustic calibration stimuli 5 is received by the test microphone 7 to produce a calibration signal input. In step 706, the calibration signal input is delivered to the audio processing electronics 8. In step 708, a level of the calibration signal input is measured and compared with reference calibration data. In step 710, a determination may be made as to whether the level of the calibration signal input is within a predefined range of calibration (e.g., a reference level). If yes, then the calibration may terminate as shown in step 712. If no, then the calibration data may be automatically adjusted based on the calibration signal input measured as shown in step 708. The delivery of acoustic calibration stimuli in step 703, the delivery of step 706, the measuring of step 708, and the determination of step 710 may then be repeated for each frequency to be calibrated. Alternatively, a composite signal representing a multitude of audiometric frequencies may be produced and corresponding calibration signal input may be produced and analyzed using the appropriated processing, for example Fast Fourier Transform (FFT). It will be understood that any of the steps described above may be repeated or cycled until a determination is made whether the level of the calibration signal input is within the predefined range.

Figure 12:
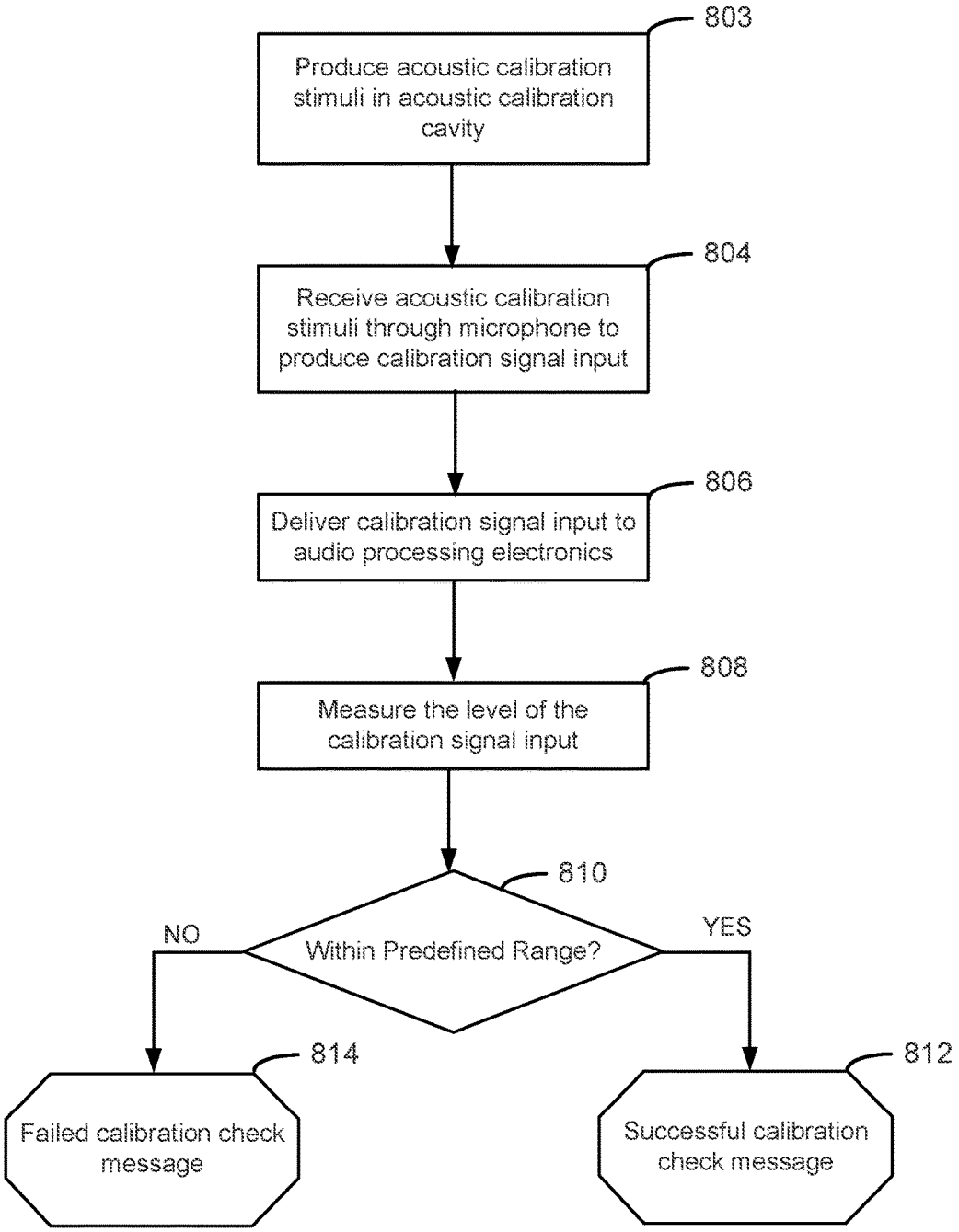
FIG. 12 is a flow chart representation for a calibration check of a hearing device using a hearing device test system, according to some examples.

FIG. 12 is a flow chart representation for a calibration check of a hearing device, according to some examples. While the various steps in this flowchart are presented and described sequentially, one of ordinary skill will appreciate that some or all of the steps can be executed in different orders and some or all of the steps can be executed in parallel. Further, in one or more embodiments, one or more of the steps described below can be omitted, repeated, and/or performed in a different order. Accordingly, the specific arrangement of steps shown in FIG. 12 should not be construed as limiting the scope of the invention.

In step 803, an acoustic calibration stimuli 5 is produced in the acoustic calibration cavity 3 by the speaker 21 of the hearing device 20 being tested. The calibration signal produces an acoustic calibration stimuli 5 which is sensed by the test microphone 7 provided within the acoustic calibration cavity 3. A remote server 70 may be accessed to retrieve any of a hearing device test software application and the reference calibration data. In step 804, the acoustic calibration stimuli 5 is received by the test microphone 7 to produce a calibration signal input. In step 806, the calibration signal input is delivered to audio processing electronics 8. In step 808, a level of the calibration signal input is measured. In step 810, a determination may be made as to whether the level of the calibration signal input is within a predefined range of calibration (e.g., a reference level). If yes, then a successful calibration check message is indicated as shown in step 812. If no, then a failed calibration check message is indicated as shown in step 814.

Figure 13:
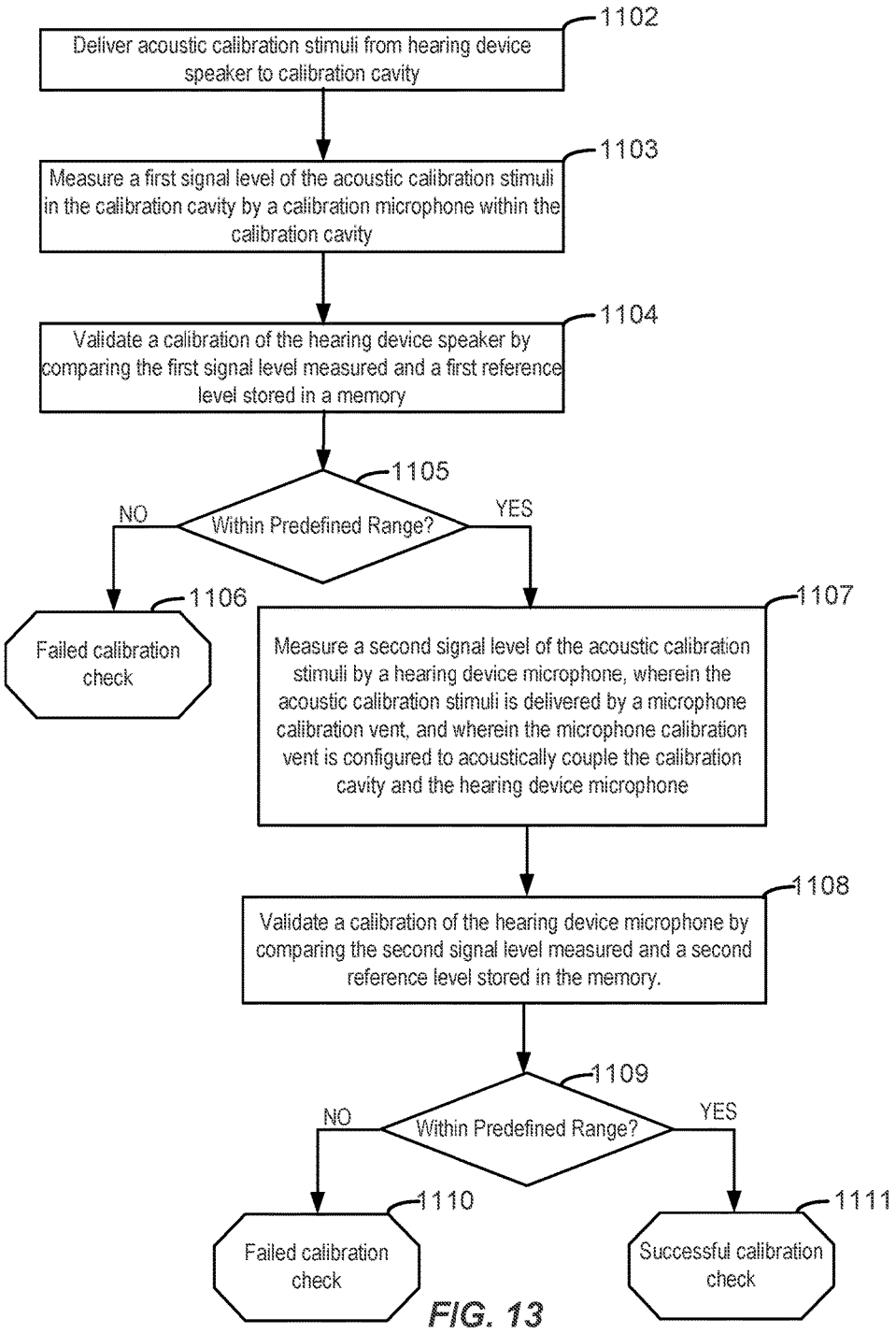
FIG. 13 is a flow chart representation for a calibration check of components of a hearing device, according to some examples.

FIG. 13 is a flow chart representation for a calibration check of a hearing device test system 100, according to some examples. While the various steps in this flowchart are presented and described sequentially, one of ordinary skill will appreciate that some or all of the steps can be executed in different orders and some or all of the steps can be executed in parallel. Further, in one or more embodiments, one or more of the steps described below can be omitted, repeated, and/or performed in a different order. Accordingly, the specific arrangement of steps shown in FIG. 13 should not be construed as limiting the scope of the invention.

In step 1102, an acoustic calibration stimuli 5 may be delivered from a hearing device speaker 21 into a calibration cavity 3 of a portable test unit 1, wherein the calibration cavity 3 is provided along an external surface of the portable test unit 1. Prior to delivery of the calibration stimuli 5, the hearing device 20 should be properly inserted into the acoustic calibration cavity 3 of the portable test unit 10, or into the test cavity of an acoustic adapter 6. In step 1103, a first signal level of the acoustic calibration stimuli 5 in the calibration cavity 3 may be measured by a test microphone 7 within the calibration cavity 3. In step 1104, a calibration of the hearing device speaker may be validated by comparing the first signal level measured and a first reference level stored in a memory. In step 1105, a determination may be made as to whether the first signal level measured is within a predefined range of calibration (e.g., a first reference level). If yes, then a calibration of the speaker and/or the sound processing electronics of the hearing device may be determined to be valid and step 1106 may take place. Steps 1102 to 1106 may be repeated for each test frequency, typically in the range of 250 to 8,000 Hz. If no, then a calibration of the speaker and/or the sound processing electronics of the hearing device may be determined to be invalid. In step 1107, a second signal is presented and level of the acoustic calibration signal through the hearing device microphone 16 may be measured. The acoustic calibration stimuli 5 may be delivered by a microphone calibration vent 9 associated with the calibration cavity 3. The microphone calibration vent 9 may be configured to acoustically couple the calibration cavity 3 and the hearing device microphone 16. In step 1108, a calibration of the hearing device microphone 16 may be validated by comparing the second signal level measured and a second reference level stored in the memory. In step 1109, a determination may be made as to whether the second signal level measured is within a predefined range of calibration (e.g., a second reference level). If yes, then a successful microphone calibration check is indicated as shown in step 1111. If no, then a failed calibration check is indicated as shown in step 1110.

In some examples, the acoustic calibration cavity 3 is provided along the outer surface of the portable test unit 10 to produce a precise and controlled acoustic transfer function when the hearing device is accommodated therein. The calibration cavity is generally shaped to match the shape of the medial end of the hearing device. The calibration cavity volume may formed to be in the range of about 0.1 to about 0.5 cc to minimize the size of the hand-held hearing device test unit. Other shapes and configurations of the calibration cavity are conceivable depending on the shape and type of the hearing device used.

Although embodiments of the invention are described herein, variations and modifications of these embodiments may be made, without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A hearing device test system for use by a non-expert user, the hearing device test system comprising:

a hearing aid device comprising a sound processor and a speaker;

a portable test unit comprising a test microphone acoustically coupled to an exterior of the portable test unit via an acoustic calibration cavity, the test microphone configured to produce a calibration signal input responsive to acoustic calibration stimuli provided by the speaker of the hearing aid device, the portable test unit further comprising a coupler at an opening to the acoustic calibration cavity configured to receive the hearing aid device at least partially therein; and a processor associated with the hearing device test system configured to measure a level of the calibration signal input and confirm a calibration of the hearing aid device if the level of the calibration signal input is within a range of acceptable reference levels for the hearing aid device.

2. The hearing device test system of claim 1, wherein the processor is configured to validate the calibration of the hearing aid device.

3. The hearing device test system of claim 1, wherein the processor is configured to validate the calibration using a calibration data stored in any of a remote server, a client computer, the hearing aid device, and the portable test unit.

4. The hearing device test system of claim 3, wherein the processor is configured to adjust the calibration data based on the measured level of the calibration signal input.

5. The hearing device test system of claim 1, wherein the acoustic calibration cavity is configured to provide a controlled acoustic transfer function for the acoustic calibration stimuli.

6. The hearing device test system of claim 1, wherein the portable test unit comprises a sealing ring provided in the acoustic calibration cavity or at the opening to the acoustic calibration cavity.

7. The hearing device test system of claim 1 further comprising an interface configured for programming of the hearing aid device.

8. The hearing device test system of claim 1, wherein the acoustic calibration cavity is configured to accommodate the hearing aid device at least partially within.

9. The hearing device test system of claim 1, further comprising an acoustic adapter configured for coupling a different hearing aid device to the portable test unit, the acoustic adapter comprising a first portion defining an opening configured to receive the different hearing aid device and a second portion comprising another opening configured to acoustically couple the different hearing aid device to the acoustic calibration cavity.

10. The hearing device test system of claim 9, wherein the first opening is configured to accommodate the different hearing aid device at least partially therein, and wherein the acoustic adapter further comprises a microphone calibration vent passing through a body of the acoustic adapter.

11. The hearing device test system of claim 9, wherein the second portion of the acoustic adapter is shaped to at least partially fit within the acoustic calibration cavity.

12. The hearing device test system of claim 1, further comprising a pod, wherein the pod comprises a speaker configured to deliver an acoustic signal to a microphone of the hearing aid device.

13. The hearing device test system of claim 1, further comprising a computing device, wherein the portable test unit is communicatively coupled to the computing device, and wherein the computing device is configured to execute a hearing device test software application.

14. The hearing device test system of claim 13, wherein the processor is part of the computing device.

15. The hearing device test system of claim 1, wherein the portable test unit comprises an audio processing electronics configured to receive the calibration signal input and wherein the processor is integrated with the audio processing electronics, a separate processor of the portable test unit, or a processor of a computing device.

16. The hearing device test system of claim 1, further comprising a headphone comprising one or more earpieces configured to produce a hearing test calibration stimuli, and wherein the acoustic calibration cavity is configured to receive the any one of the one or more at least partially therein.

17. The hearing device test system of claim 1, a microphone calibration vent incorporated within the acoustic calibration cavity is configured to transmit the acoustic calibration stimuli to a microphone of the hearing aid device.

18. A portable test unit comprising:

an acoustic chamber defining an acoustic calibration cavity acoustically coupled to an exterior of the portable test unit, wherein the acoustic calibration cavity is configured to accommodate a hearing aid device or an acoustic adapter at least partially within;

a test microphone acoustically coupled to the acoustic calibration cavity, the test microphone configured to produce a calibration signal responsive to an acoustic calibration stimuli from the hearing aid device, wherein the hearing aid device comprises a speaker and a sound processor; and a processor configured to receive the calibration signal and confirm a calibration of the hearing aid device if a level of the calibration signal is within a range of acceptable reference levels for the hearing aid device.

19. A method of checking a calibration of a hearing aid device, the method comprising:

acoustically coupling a hearing aid device to an acoustic calibration cavity of a portable test unit, wherein the hearing aid device comprises a sound processor and a speaker;

transmitting an acoustic calibration stimuli from the speaker of the hearing aid device to a test microphone within the portable test unit;

producing a calibration signal by the test microphone in response to the acoustic calibration stimuli;

transmitting the calibration signal to a processor associated with the portable test unit; and comparing a level of the calibration signal to a range of reference levels; and confirming a calibration of the hearing aid device if the level of the calibration signal is within the range of acceptable reference levels for the hearing aid device.

20. The method of claim 19, wherein acoustically coupling the hearing aid device includes at least partially inserting the hearing aid device within the acoustic calibration cavity of the portable test unit.

21. The method of claim 19, wherein acoustically coupling the hearing aid device includes coupling an adapter to the acoustic calibration cavity of the portable test unit and at least partially inserting the hearing aid device within the adapter.

22. The method of claim 19, further comprising accessing a remote server hosting any of a hearing device test software application and reference calibration levels.

23. The method of claim 19, further comprising adjusting calibration data of the hearing aid device if the calibration of the hearing aid device is determined to be outside a reference calibration range, and storing the adjusted calibration data in memory of the hearing aid device.

24. The method of claim 19, further comprising:

measuring a first signal level of the acoustic calibration stimuli in the acoustic calibration cavity;

validating the calibration of the hearing aid device by comparing the first signal level to the range of reference levels;

measuring a second signal level of an acoustic stimuli received by a microphone of the hearing aid device, wherein the acoustic stimuli is delivered to the microphone by a microphone calibration vent acoustically coupling the acoustic calibration cavity to the hearing aid device microphone; and validating a functionality of the microphone of the hearing aid device by comparing the second signal level to a second range of reference levels.

* * * * *